United States Patent [19]

Hopkins et al.

[11] 4,036,463

[45] July 19, 1977

[54] PAINT CAN AND BRUSH RECEPTACLE

[75] Inventors: Jeffrey E. Hopkins, Danville, Va.; Bobby B. Bennett, Reidsville, N.C.

[73] Assignee: Jeffrey E. Hopkins, Danville, Va.

[21] Appl. No.: 692,648

[22] Filed: June 4, 1976

[51] Int. Cl.[2] ..... B44D 3/12; E06C 7/14

[52] U.S. Cl. ..... 248/210; 248/110; 248/311.1

[58] Field of Search ..... 248/110, 210, 211, 238, 248/311.1; 220/85 H; 15/257.06; 211/71

[56] References Cited

U.S. PATENT DOCUMENTS

| | | | |
|---|---|---|---|
| 1,313,803 | 8/1919 | Dunn | 248/210 |
| 3,182,943 | 5/1965 | Crossman | 248/210 |
| 3,407,429 | 10/1968 | Nardo | 220/85 H X |
| 3,576,045 | 4/1971 | Stafford | 15/257.06 |
| 3,593,951 | 7/1971 | Warner | 248/210 |
| 3,940,824 | 3/1976 | Gioia et al. | 15/257.06 |

*Primary Examiner*—J. Franklin Foss

[57] ABSTRACT

A receptacle for a paint can and brushes is mounted for quick release to a support bracket, which in turn is pivotally attached to a clamping bracket, adapted to be clamped to the side rail of the ladder. The pivotal attachment between the ladder clamping bracket and the receptacle support bracket insures that the paint can remains level regardless of ladder inclination. In addition, the brush well is conveniently positioned between the paint can support housing and the clamping mechanism to provide a depository for brushes when not in use. A passageway between the brush well and the paint can housing allows excess paint to drip back into the housing and, because of the construction of the bottom wall of the paint can housing, be kept out of contact with the bottom of the paint can.

5 Claims, 2 Drawing Figures

PAINT CAN AND BRUSH RECEPTACLE

REFERENCE TO RELATED APPLICATIONS

One of the joint inventors in the instant application is also the inventor in co-pending application, Ser. No. 643,502 filed Dec. 22, 1975, which is directed to an earlier configuration of a paint can and brush receptacle with some, but not all, of the advantages of the embodiment which is the subject of the present application.

SUMMARY OF THE INVENTION

The present invention, on the other hand, is directed to an improved version of the Hopkins application Ser. No. 643,502, and in this regard is directed to a receptacle and support bracket apparatus which may be easily attached to a painter's ladder, and on which a paint can may be deposited within easy access of the painter on the ladder. Further the apparatus includes a pocket into which brushes may be deposited when not in use.

Structurally the apparatus includes a first or ladder clamping bracket releasably attachable to the side rail of the ladder. A second or receptacle support bracket is pivotally attached for free movement to the first bracket and includes a hanger means for quickly and releasably mounting the paint can and brush receptacle. The brush and can receptacle includes a cylindrical can receiving housing having an open top and a brush well. The brush well is a generally rectangular box-shaped member having an open top and protruding outwardly from the periphery of the upper end of the paint can receiving housing. The protruding brush well is of such size and shape as to protrude within and be held by the hanger member on the second of said aforementioned brackets, thereby releasably suspending the entire receptacle therefrom.

The support means by which the can and brush receptacle is attached to the ladder includes a first, U-shaped bracket, having a distance between the legs thereof at least as great or slightly greater than the width of the side rail of the ladder. A pair of set screws extend through one wall of the first bracket to securely fasten the bracket onto the ladder rail. A second, generally U-shaped bracket, with one of the legs shorter than the other, is pivotally attached to the first bracket by means of a rivet or screw through the long leg thereof which permits the second bracket to pivot freely about the first. A hook or hanger member is incorporated into the shorter arm of the second bracket for releasably mounting the paint can and brush receptacle thereon by means of the brush well which fits within a cutout in the shorter arm and maintains the receptacle thereon until it is desired to be lifted off.

So arranged, the paint can levels itself regardless of the inclination of the ladder as a result of gravity, and both the paint can and the brush receptacle are kept convenient to the painter at all times. The support means for the device is more securely attached to the ladder rail and provides a stronger support than is described in the earlier Hopkins application Ser. No. 643,502. Also, in this invention, the paint can and brush receptacle may be lifted as a unit from the supporting brackets, without removing the support bracket from the ladder itself, thereby facilitating the painting operation by maintaining the brush and can receptacle with the can and brush at all times. The arrangement provides easy access to the paint can, a brush storage facility that is easily accessible requiring a minimum of searching and manipulation, as well as providing sturdier construction, assemblage, and a separable receptacle and support bracket.

It is therefore an object of the present invention to provide an improved painter's accessory, whereby paint cans and brushes may be suitably and securely maintained in a location easily accessible to a painter on a ladder.

A further object of the present invention is to provide a device of the type described which will maintain the paint can at a level attitude regardless of the ladder inclination.

Furhter, it is an object of the present invention to provide a device of the type described, which, in addition to receiving a paint can, also receives paint brushes, not in use, in a convenient, easily accessible location.

Still another object of the present invention is to provide a device of the type described, in which the supporting bracket is more securely attached to the ladder, and in which the can and brush receptacle may be removed and separated from the support bracket for ease and convenience in painting set-up time.

Other objects and a fuller understanding of the invention will become apparent after a consideration of the following detailed description of the preferred embodiment read in conjunction with the accompanying drawings in which.

DETAILED DESCRIPTION OF A PREFERRED EMBODIMENT

Figure 1:
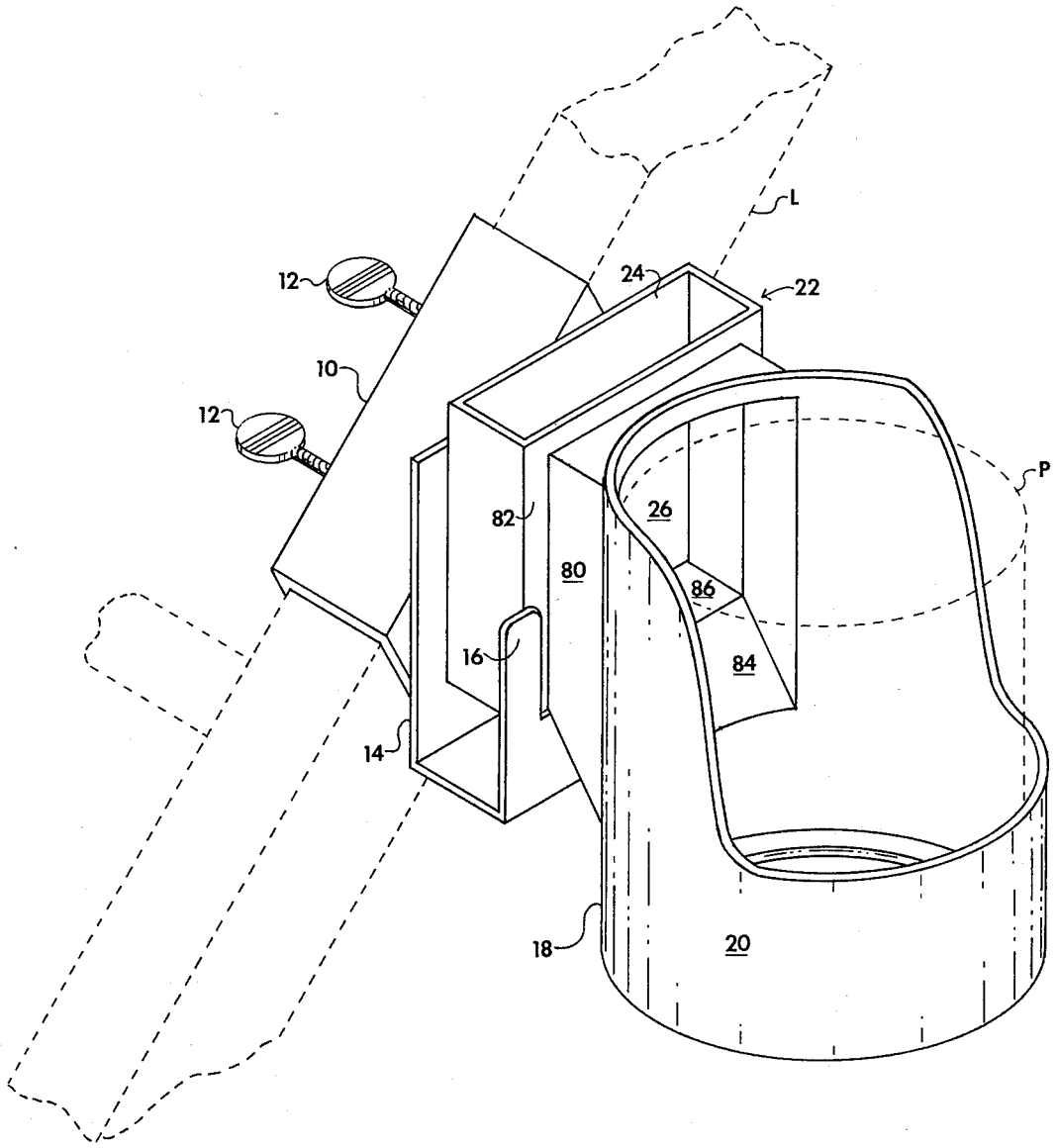
FIG. 1 is a perspective view illustrating the present invention.

In the drawings there is illustrated a device for suspending a paint can P from the side rail L of the ladder and for providing a nearby receptacle for brushes B, both within easy access to a painter on the ladder. In general, the device includes a support means including a first or ladder clamping bracket 10 having a clamping means 12 for releasably mounting the ladder clamping bracket 10 securely to the side rail L of the ladder. A receptacle support bracket 14 is pivotally attached to the ladder clamping bracket 10 and includes a hanger means 16 for releasably suspending a combination paint can and brush receptacle 18 therefrom.

The receptacle 18 itself includes a cylindrical can receiving housing 20 having an open top, a brush well 22 including a generally rectangular housing 24 having an open top, and protruding from one side of the upper end of the can receiving housing 20. The brush well 22 is of such size and so shaped at to be removably suspended from the hanger member 16 with the brush well 22 lying in a position within the opposed walls of bracket 14.

If desired, an opening 26 may extend through the common wall of the paint can housing 20 and the brush well 22 to provide communication therebetween, whereby when paint drips from the bristles of paint brush B, it drops down into the bottom of paint can housing 20, rather than building up in the bottom of housing 24.

Figure 2:
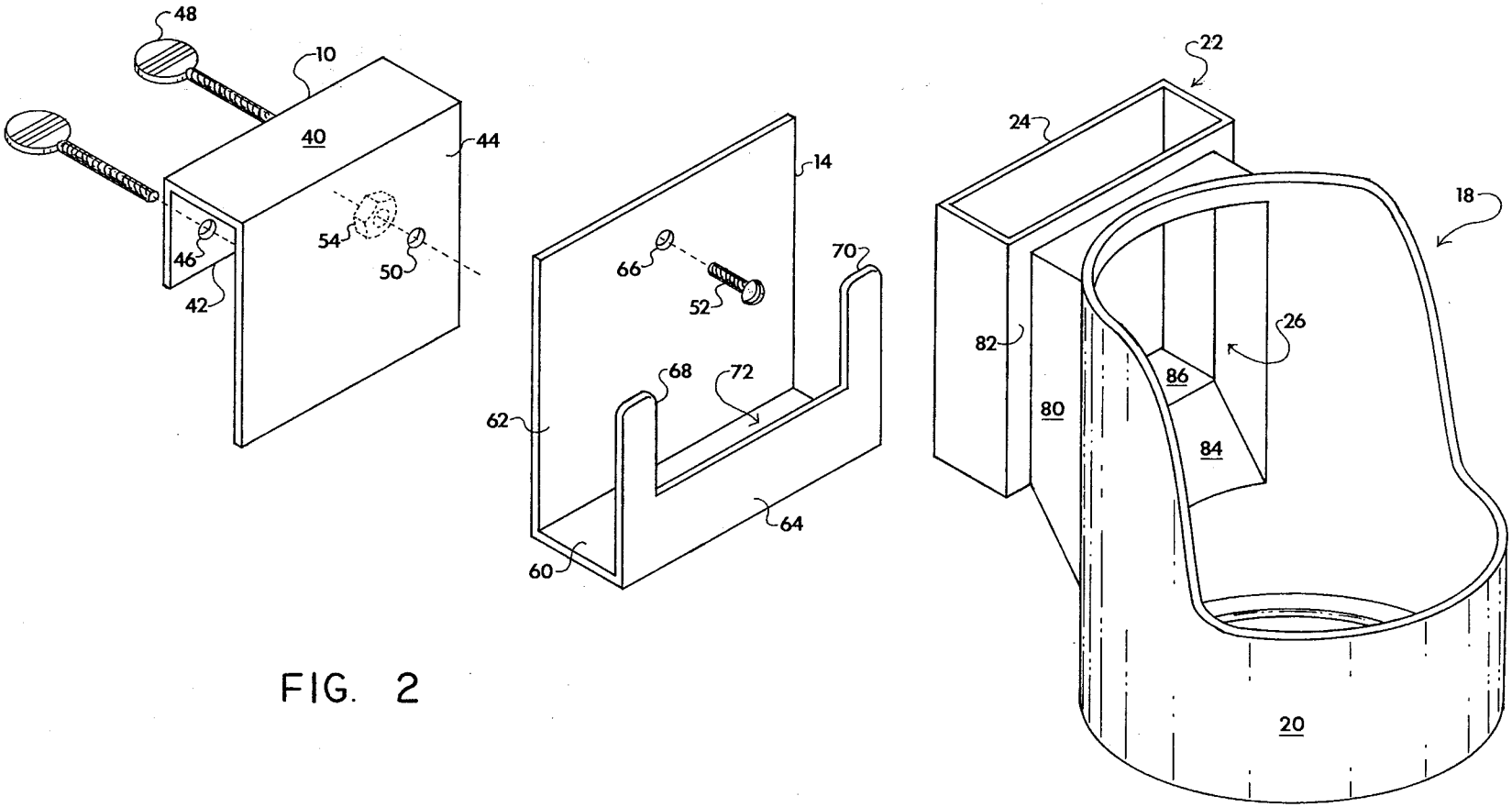
FIG. 2 is a perspective view similar to FIG. 1, except the components have been separated to facilitate comprehension of the invention.

Turning now to the exploded view illustrated in FIG. 2, each of the elements of the invention are more easily viewed and understood. The ladder clamping bracket 10 is preferably a U-shaped, metallic member having a base 40 and a pair of parallel side walls 42,44 depending from opposite edges of base 40. The distance between side walls 42,44 is about the same or slightly greater than the thickness of a conventional ladder rail L. A pair of spaced threaded openings 46 are fabricated in wall 42 and the fastening means 12 includes a set screw 48 extending through each threaded opening 46 into contact with the ladder rail itself to tighten the bracket thereagainst. On the other or opposite wall 44 of the bracket 10 an opening 50 receives a threaded pivotal connector 52 with a nut 54 secured to the other side thereof for pivotally mounting receptacle support bracket 14 thereto as will be hereinafter described.

The second or receptacle support bracket 14 also is fabricated from a U-shaped metallic member having a base wall 60 and two parallel, upstanding side walls 62,64, with side wall 62 being substantially longer than the opposite side wall 64. An opening 66 in side wall 62 communicate with the opening 50 in the first bracket through which the pivotal connector 52 extends, thereby freely and pivotally mounting bracket 14 to bracket 10. It should be recongized that although pivotal connector 52 is illustrated with threads secured to a nut 54 on the opposite side of wall 44, rivets or other freely pivotal connector elements could be used to connect the two brackets 10,14 together. The hanger member 16 is formed in side wall 64 and comprises a pair of extensions or ears 68,70 extending upwardly from each end of a depressed or cut-out area 72 therebetween. It is in this cut-out area 72 between the two ears 68,70 that the paint can and brush receptacle 18 is removably suspended as described hereinbelow.

The paint can and brush receptacle includes a can support 18 and brush well 22, which are combined into one integral body member formed separately from the two brackets 10,14 and removably mounted thereto. The paint can support 18 includes a cylindrical housing 20 open at the top and having a portion of one side cut out as illustrated in FIGS. 1 and 2 for easy emplacement and removal of paint can P. An opening or cut-out 26 is formed in the portion of the side wall which is not cut down, and a connecting wall 80 extends outwardly from the edges of the cut-out 26 and merges with rectangular housing 24 as illustrated in FIG. 2. The diminsions of housing 24 are slightly larger than wall 80, so that a shoulder 82 is formed in the front wall of housing 24. The front wall of housing 24 includes an opening therein corresponding to and approximately the same size as opening 26 in housing 20, with the exception that the lower edge thereof is at a slightly higher elevation than the lower edge of cut-out 26 in housing 20. A tapered wall 84 connects the lower wall 86 of housing 24 with the lower edge of cut-out 26 in housing 20. So arranged, paint which drips down from the brushes deposited in paint well 22 follows the inclined wall 84 and drips into the bottom of housing 20. A ridge 88 is formed concentric to the periphery of housing 20 and extends upwardly from the lower wall or floor thereof, so that when paint which drips into the bottom portion thereof does not come into contact with the bottom surface of the paint can P.

The manner in which the paint can and brush receptacle is mounted on bracket 14 is illustrated in FIG. 1. In this regard, the distance between upstanding ears 68,70 is slightly greater than the corresponding distance between the side walls of outwardly projecting wall 80, but slightly less than the corresponding distance between the side walls 83,85 of brush well 22, so that the shoulder 82 fits behind ears 68,70 when the receptacle is mounted, and prevents inadvertent removal therefrom. It is a simple matter, however, to lift the receptacle 18,22 therefrom when it is desired to do so.

It is evident that various changes and modifications might be possible without departing from the scope of the present invention, which is set forth in the following claims:

That which is claimed is:

1. Device for releasably suspending a paint can and brush from the side rail of a ladder within easy access of a painter thereon and for self-leveling the paint can comprising:

a. a receptacle including a paint can housing and a brush well;

b. a ladder clamping bracket with clamping means for releasably mounting said ladder clamping bracket to said side rail;

c. a receptacle support bracket attached to said ladder support bracket for free pivotal movement about a horizontal axis to form a self-leveling support, and including a hook-like hanger means for releasably suspending said receptacle therefrom;

d. said receptacle comprising:

i. a cylindrical can receiving housing having an open top and of such dimension as to receive a one-gallon paint can;

ii. a brush well including a generally rectangular housing having side walls and an open top of such relative size as to support brushes upright therein when not in use, and protruding from one side of the upper end of said can receiving housing; and iii. said brush well housing being of such size and shape as to be suspended without fasteners from said hanger means with said brush well being positioned between said can receiving housing and said ladder side rail.

2. The device according to calim 1 and further including a passageway extending through the adjacent walls of said brush well and said paint can housing, whereby excess paint drippings in said brush well are caused to drop into said paint can housing.

3. The device according to claim 1 wherein the hanger means of said receptacle support bracket comprises an upstanding wall having a pair of spaced, ears extending upwardly therefrom and a recessed portion therebetween, the distance between the side wall of said brush well housing being greater than distance between the ears of said recess, and a connecting wall between said brush well housing and said paint can housing of a corresponding dimension less than the distance between the ears of said recess, whereby said paint can and brush receptacle may be selectively and releasably suspended therefrom.

4. The device according to claim 1 wherein said receptacle support bracket comprises a U-shaped member with a base and a pair of spaced side walls extending outwardly from the opposite edges thereof, one of said side walls having said hanger means incorporated therein, and the other of said side walls including an opening therein, said ladder clamping bracket including a corresponding opening therein and a pivotal connector extending through the openings in said receptacle support bracket and said ladder clamping bracket for pivotally connecting the two brackets together.

5. The device according to claim 2 wherein a tapered bottom wall connects the lower wall of said brush well with the adjacent wall of said paint can housing to permit flow of paint by gravity from said brush well into said paint can housing.

* * * * *